US008661977B2

(12) United States Patent
Fink et al.

(10) Patent No.: US 8,661,977 B2
(45) **Date of Patent: *Mar. 4, 2014**

(54) SHAPED FEED-THROUGH ELEMENT WITH CONTACT ROD SOLDERED IN

(71) Applicant: Schott AG, Mainz (DE)

(72) Inventors: Thomas Fink, Landshut (DE); Reinhard Ranftl, Pfeffenhausen (DE)

(73) Assignee: Schott AG, Mainz (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/827,576

(22) Filed: Mar. 14, 2013

(65) Prior Publication Data

US 2013/0199392 A1 Aug. 8, 2013

Related U.S. Application Data

(63) Continuation of application No. 12/658,715, filed on Feb. 12, 2010, now Pat. No. 8,397,638.

(30) Foreign Application Priority Data

Feb. 12, 2009 (DE) ..... 10 2009 008 673

(51) Int. Cl.
*F42B 3/10* (2006.01)
*F42B 3/04* (2006.01)
*B23K 31/02* (2006.01)

(52) U.S. Cl.
USPC ..... 102/202.14; 228/164

(58) Field of Classification Search
USPC ..... 102/202.5, 202.7, 202.8, 202.9, 202.11, 102/202.12, 202.14, 275.11; 228/164, 165, 228/168
See application file for complete search history.

(56) References Cited

U.S. PATENT DOCUMENTS

| | | | |
|---|---|---|---|
| 3,044,342 | A | 7/1962 | Jones |
| 3,249,047 | A | 5/1966 | Gill et al. |
| 4,816,621 | A | 3/1989 | Huebner et al. |
| 4,841,101 | A | 6/1989 | Pollock |

(Continued)

FOREIGN PATENT DOCUMENTS

| | | | |
|---|---|---|---|
| CN | 1795117 | A | 6/2006 |
| CN | 1835895 | A | 9/2006 |

(Continued)

OTHER PUBLICATIONS

First Office Action received Jan. 31, 2013 from corresponding Chinese Patent Application No. 201010121664.5, 11 pages.

(Continued)

*Primary Examiner* — Bret Hayes
(74) *Attorney, Agent, or Firm* — Ohlandt, Greeley, Ruggiero & Perle, LLP

(57) ABSTRACT

A feed-through element of an ignition device for igniters of airbags or seatbelt tighteners is provided. The feed-through element has a metal support body, at least one first access opening in which a metal rod is arranged in an electrically insulating fixing material, and at least one second access opening in which a further metal rod is electrically conductively fixed to the support body by a soldered connection in this access opening. The support body and the access openings are configured as a shaped part. The feed-through element further includes a solder gap between the metal rod and the wall of the second access opening, where the solder gap has a small width.

31 Claims, 5 Drawing Sheets

(56) References Cited

U.S. PATENT DOCUMENTS

| | | | | |
|---|---|---|---|---|
| 5,345,872 | A | 9/1994 | Takahashi et al. | |
| 5,431,101 | A | 7/1995 | Arrell, Jr. et al. | |
| 5,732,634 | A | 3/1998 | Flickinger et al. | |
| 5,798,476 | A | 8/1998 | Bailey | |
| 6,343,000 | B1 | 1/2002 | Yokoyama et al. | |
| 6,557,474 | B1 | 5/2003 | Morte et al. | |
| 6,612,241 | B2 | 9/2003 | Avetisian | |
| 7,770,520 | B2 | 8/2010 | Fink et al. | |
| 7,975,611 | B2 | 7/2011 | Bjorn | |
| 8,397,638 | B2 * | 3/2013 | Fink et al. | 102/202.14 |
| 2003/0192446 | A1 | 10/2003 | Berg et al. | |

FOREIGN PATENT DOCUMENTS

| | | | |
|---|---|---|---|
| DE | 10133223 | A1 | 10/2002 |
| DE | 102005009644 | A1 | 9/2006 |
| EP | 1061325 | A1 | 12/2000 |
| EP | 1455160 | A1 | 9/2004 |

OTHER PUBLICATIONS

Translation of German Office Action dated Sep. 16, 2009 from German Patent Application No. 10 2009 008 673.0-21, 4 pages.

* cited by examiner

SHAPED FEED-THROUGH ELEMENT WITH CONTACT ROD SOLDERED IN

CROSS REFERENCE TO RELATED APPLICATIONS

The present application is a continuation of U.S. patent application Ser. No. 12/658,715, filed on Feb. 12, 2010, which in turn claims benefit under 35 U.S.C. §119(a) to German Patent Application No. 10 2009 008 673.0-21, filed Feb. 12, 2009, and the entire contents of each application are incorporated herein by reference.

BACKGROUND OF THE INVENTION

1. Field of the Invention

The present disclosure relates to feed-through elements in general, but in particular those for ignition devices such as are used to ignite a pyrotechnic person protection device. In particular, the present disclosure relates to the configuration of the base of such an ignition device.

2. Description of Related Art

In particular, airbags and seatbelt tensioners are used as person protection devices in motor vehicles. Such safety systems can significantly reduce the risk of injury. A prerequisite, however, is that the safety systems in question do not fail in the event of a collision. Particular attention is paid to the igniters of such pyrotechnic apparatus, which are indispensable for the function of such safety apparatus. In particular, the igniters must still function properly even many years after their production. As an average lifetime of such igniters, 15 years is often specified. In order to guarantee proper long-term function, it is necessary to ensure that the propellant charge provided in the igniter is not degraded in the course of time. Such degradation may, for example, be caused by moisture entering the igniter. It is therefore important to hermetically encapsulate the propellant charge of the igniter. The igniter must also release the gases of the ignited propellant charge in the correct direction, in order to ignite the propellant charge of a gas generator of the safety system.

In order to ensure this, igniters known from the prior art comprise a cap or cover and a comparatively solid base, between which the propellant charge is enclosed in a cavity formed by these parts. The current for igniting the propellant charge is delivered through the base by means of electrical connections. The base therefore generally comprises access openings, in which there are metal rods that can be supplied with the electrical current on one side by means of a plug connection and are connected on the other side, for example by means of an ignition bridge which causes the propellant to ignite when the flow of current comes in contact with the latter. The base is therefore generally referred to as a feed-through element. When configuring the feed-through element, it is necessary to ensure that when the propellant charge is ignited, the cap or cover or a part of it always breaks and the electrical feed-throughs are not driven out of the base.

Two technologies have gained acceptance on the market for such feed-through elements. In the first, the support body of the base consists of metal and the ignition bridge is produced by means of a bridging wire welded on. In this embodiment, a metal rod is fixed as a pin in an electrically insulating fixing material in an access opening of the support body. A glass material, in particular a resin glass or glass solder, is conventionally used as the glass material. This metal rod is therefore insulated from the outer conductor by glass. A second metal rod as a pin is welded or soldered to the outer conductor which is represented by the support element, also known as a baseplate. On the inner side of the feed-through element—that is to say the side which faces towards the ignition cap of the finally mounted ignition device—a bridging wire (usually made of a tungsten alloy) as an ignition bridge comes in contact with the surface of the glass material. So that the bridging wire is not damaged and the ignition element has a long lifetime in service, for example in a motor vehicle, the surface of the glass material must be ground since surface roughness can damage the bridging wire.

The length of the wire influences the resistance and therefore the triggering characteristic of the ignition device. In the event of ignition, the resulting explosive pressure acts on a small glass surface, so that this embodiment may be regarded as very robust. Another acknowledged advantage of this version is that a pin is directly connected to the outer conductor, and simple earthing of the igniter takes place through this pin. Disadvantages are the higher process costs due to the surface grinding of the glass material. Furthermore, only stainless steel can be used for the outer conductor for corrosion reasons, and the resistance depends on the positioning tolerance of the pin in the glass as a fixing material and on the wire length. This type of igniter is nevertheless the most widespread one.

Ignition devices of this type are known, for example, from DE 101 33 223 A1. The version described in US 2003/0192446 A1 also belongs to this group, even though grinding can be obviated therein since the plane surface, on which the bridging wire comes to bear, is produced by an additional ceramic body. This, however, entails extra production costs. Furthermore, the pin which is intended to establish the connection to the outer conductor is covered by the glass material. This prevents visual inspection and therefore makes the required quality inspection during production more difficult.

A second technology used in order to produce ignition devices is based on support bodies made of pressed glass as a base, through which two metal rods are fed as an electrical supply and connection elements. A ceramic with a thick-film conductor as an ignition bridge is soldered onto the pin ends. Two short pin ends on the inner side extend beyond that of the base, i.e. they have a projection relative to the glass surface. In order to produce such a feed-through element, the liquid glass must be elaborately pressed. Since both pins have been insulated, a connection to the outer conductor must be established. This is done as described in EP 1061325 A1 by means of an additional component. The advantages of this embodiment are the freer selection of the outer conductor material, and the fact that the positioning tolerances of the pin in the access opening do not affect the resistance since it is predefined by the ceramic substrate or chip. Disadvantages are the larger area of glass, which weakens the design, as well as the more elaborate earthing and higher total costs of the system. This type of igniter is therefore less widespread.

Owing to the described stability requirements of the base, its support body has to date been configured very solidly. This requires the outer contour of the support body to be formed by turning on a lathe, whereas the access openings have been drilled. Both processes are time-consuming and therefore make production more expensive.

U.S. Pat. No. 6,557,474 B1 proposes to configure the support body as a stamped metal part. The fundamental problem with stamping support bodies, however, is that the access openings have to be stamped with great accuracy, particularly in respect of the diameter variance and the profile of the access opening. The thicker the support body is, i.e. the higher its material width is, the greater the inaccuracies are. U.S. Pat. No. 6,557,474 B1 is therefore based on a very thin support body, which is in conflict with the requirement for stability of the component. In this document, a relatively thick glass layer is therefore applied onto the stamped metal part in order to stabilize it.

However, the glass must still be pressed. In the event of the ignition, the entire explosive force acts on the glass, and it is therefore not mechanically stable enough. In a structure of this type, the connection between the glass and metal can only be made by means of a chemical reaction, to which end the glass and the metal must have the same thermal expansion. This is possible solely and exclusively with an NiFeCo alloy as the material for the stamped metal part. The material costs of the NiFeCo alloy, however, are extremely high. Owing to these disadvantages, this embodiment has not yet come into use.

EP 1455160 B1 proposes to use a single stamped metal part of sufficient stability as the support body. Both the outer contour of the support body and the access opening, in which a pin is fixed by means of a glass solder, are formed by a stamping process. The pin, which establishes the contact with the outer conductor, is not fixed in an access opening in this embodiment but instead soldered over a large area to the lower side of the support body. Stamping of the access opening, in which the glass-metal fixing takes place, is possible since the access opening is subject to minor requirements with respect to the accuracy of the diameter and the profile, since with suitable process management it is possible to compensate for large solder gaps and therefore also large tolerances by fixing the pin with the glass fixing material. Conventionally, the upper side of the glass surface is ground, so that this embodiment belongs to the group of feed-through elements mentioned first. This embodiment also suffers from the disadvantage that the support body conventionally consists of a stainless steel, because otherwise the support body made of a non-stainless metal would need to be coated in order to avoid corrosion. In the case of such coated support bodies, however, the glass surface of the glass-metal feed-through can then no longer be ground because otherwise the coating would be abraded as well. The costs for production furthermore are increased by grinding and polishing the glass surface of the one glass-metal feed-through, by welding the bridging wire and the process outlay for producing the large-area soldering of the earth pin onto the support body.

Because welding the cap to a stamped support body can lead to thermal stresses of the likewise stamped glass-metal feed-through, which may put its leaktightness at risk, DE 10 2005 009 644 A1 proposes to provide the support body with a thin welding edge. This document discloses embodiments with an access opening and an earth pin, which is soldered to the lower side of the support body in the manner of the aforementioned EP 1455160 B1. An alternative embodiment presents a support body with a stamped and drilled access opening, and an ignition bridge applied as a thick-film conductor.

Against this background, it is an object of the present disclosure to provide a feed-through element which is suitable for use in pyrotechnic person protection devices, but which is produced at reduced costs.

BRIEF SUMMARY OF THE INVENTION

The object is achieved by the feed-through element and the method for its production according to the present disclosure.

A feed-through element according to the present disclosure comprises a metal support body and at least one first access opening in which a metal rod is arranged in an electrically insulating fixing material, and at least one second access opening in which a further metal rod is fixed by a soldered connection in at least one solder region in this access opening, the solder material of the soldered connection electrically conductively filling a solder gap between the metal rod and the inner wall of the second access opening inside the solder region. Both the outer contour of the support body and the first access opening are formed by a shaping process. The inventors have discovered that it is also possible for the at least one second access opening, in which the metal rod is fixed by the soldered connection, likewise to be formed by a shaping process which is configured so that this access opening has a predominantly cylindrical profile at least in subregions of the solder region, the difference between the diameter of the cylindrical region of this access opening and the diameter of the metal rod fixed in this access opening being at most 0.30 millimeters ("mm").

According to the present disclosure, the support element is therefore a shaped metal component and, in addition to the metal rod which is fixed in the glass material, at least one further metal rod which establishes the contact with the outer conductor, and therefore represents the earth conductor, is fixed in an access opening by means of an electrically conductive solder.

As shaping, in the context of the present disclosure, the shaping method is to be understood. This comprises in particular cold forming and/or stamping. If no material erosion takes place and/or is used during the cold forming, all cold forming methods in principle have the common feature that the volume of the starting material is essentially equal to the volume of the cold-formed workpiece. In the case of cold forming, the contour of the finished workpiece depends on the shape of the tool in which the starting material is pressed during the cold forming, whereas in the case of stamping the contour of the finished workpiece or of the regions processed by stamping depends on the shape of the stamping tool. The person skilled in the art knows various cold forming methods, which he or she may also suitably combine with one another or use in combination with stamping to produce the feed-through element according to the present disclosure.

A basic concept of the present disclosure is that the entire support body is a shaped component, i.e. both its outer contour and the access openings are produced by shaping in order to produce it. The contour of the support body may in particular have been formed by cold forming and/or stamping. According to the present disclosure, the access openings are made in the support body by a shaping process while removing material from it. The shaping process preferably used for this is stamping. By examinations of the material structure and surface on the feed-through elements, it can be established whether a shaping method has been used for its production or a conventional material-removal production method known from the prior art. The production methods therefore establish a product property of the feed-through element.

In a stamping process, such as is used according to the present disclosure to produce the access openings, in principle a characteristic stamping profile is however produced. If the access opening is stamped into the support body, on the penetration side of the stamping tool it usually first has a relatively smooth and uniform profile which, however, typically splits with an increasing penetration depth or workpiece thickness, i.e. the profile of the access opening is widened with an increasing workpiece thickness in the direction of the exit side of the stamping tool. In this description, the profile of the access opening is intended to mean the three-dimensional shape of the access opening. When reference is made to a predominantly cylindrical profile, this means that a primarily cylindrical structure has been stamped out of the region of the access opening. Slight differences from this ideal geometry are inherently possible and likewise covered by the present disclosure.

The problem which then occurs is that the metal rod must be fixed by means of the electrically conductive solder in the access opening, even though it has the typical stamping profile. This is achieved according to the present disclosure on the one hand in that the inventors have discovered that the cylindrical region of the stamped profile of the access opening is large enough to achieve sufficiently leaktight and extraction-proof soldering by means of a metal solder in this region. The solder region—that is to say the region in which the metal rod is soldered into the access opening—then lies at least partially inside the cylindrical region of the stamped profile. Of course, the present disclosure also includes the situation that the solder region fills only a part of the cylindrical region or extends beyond it. Preferably, the solder region lies fully inside the predominantly cylindrical region of the profile of the access opening.

Another problem which occurs when soldering a metal rod in a stamped access opening is the dimensioning of the solder gap. The solder gap is the region between the inner wall of the access opening and the metal rod fixed in it. From the specialist literature, it is known that the solder gap between the components should have a width of about 0.1 mm when soldering two components by means of electrically conductive solder. With this distance, the solder can flow well between the components by adhesion. If the gap is too small, not enough solder can enter. If it is too large, air inclusions or unwetted surfaces occur. Hermetically sealed and pressure-resistant or extraction-proof closure is categorically necessary for the intended application.

The inventors have discovered that, despite the described typical stamping profile, it is surprisingly possible to stamp an access opening with sufficient accuracy in respect of its profile and the geometry and dimensions of the diameter in the support body. The metal rods used for airbag igniters are standardized in diameter to the dimension 1.0+/−0.05 mm. So that the metal rod can be fixed in the access opening, the diameter tolerance of the metal rod should not overlap with the diameter of the access opening, although on the other hand some assembly play must in fact be taken into account. If the access opening is selected to be too large, as described, a sufficiently leaktight soldered connection cannot be obtained.

According to the present disclosure, the access opening for this metal rod is therefore stamped in the support body with a diameter such that the difference between the diameter of this access opening and the diameter of the metal rod fixed in this access opening is at most 0.30 mm.

In a preferred embodiment, a feed-through element according to the present disclosure comprises an access opening for the metal rod fixed in it by means of an electrically conductive solder, wherein the subregion with the cylindrical profile is followed by a region which is widened relative to the said cylindrical profile. The widened region preferably has a conical profile. Such a configuration may be obtained by a stamping process from one side, but also a succession of stamping processes in which the shape and therefore the profile of the access opening are formed. In an at least two-stage stamping process, for example, it is possible to form a stepped profile, in particular when the hole is first stamped through the support body from one direction and then the contour of the step is imposed and/or stamped in from the opposite direction. Such widened regions may of course also lie on both sides of the support body and therefore on both sides of the access opening.

The metal rods, which are fixed in the access openings, are preferably produced with a diameter of 1.00±0.03 mm.

The solder gap inside the solder region with the predominantly cylindrical profile preferably has a maximum width of 0.23 mm, particularly preferably 0.20 mm. This covers in particular the cases in which the metal rod is not soldered centrally in the access opening, i.e. not concentrically.

In a preferred embodiment, however, the metal rod is essentially fixed concentrically in the second access opening by an electrically conductive solder material in the access opening, and the solder gap inside the predominantly cylindrical profile preferably has a width of at most 0.18 mm.

In a particularly preferred embodiment, the diameter of the second access opening, in which the metal rod is connected to the support body by means of an electrically conductive solder, inside the predominantly cylindrical profile is 1.10±0.07 mm. The specified tolerance refers to the possible differences from the ideal round geometry as well as differences in the absolute values of the diameter.

In order to ensure maximal cost efficiency of the feed-through element according to the present disclosure, the metal support body preferably does not consist of stainless steel.

Instead, the support body is preferably formed from a steel of the group 1.01xx to 1.07xx (unalloyed quality steels). The steel group is specified according to DIN EN 10 027-2, the first digit indicating the main material group and the sequence of digits after the first point specifying the steel group numbers.

In order to ensure the best possible corrosion resistance, the support body may be coated with metals. A nickel coating is preferably used. This applies in particular for support bodies which are formed from unalloyed quality steels.

Since high explosive pressures of usually more than 1000 bar can occur in airbag igniters in the event of ignition, the support body must be configured with a correspondingly high thickness, i.e. material width. The thickness of the support body lies in the range of from 1.5 mm to 4 mm. Preferably in the range of from 1.7 to 3 mm, particularly preferably from 1.8 to 2.5 mm. To date, it has not been considered possible to stamp a hole with a diameter of about 1.1 mm in a steel of this thickness with the accuracy required for soldering. Only the efforts by the inventors have shown its feasibility.

In a preferred embodiment, the at least two metal rods are fixed in the access openings so that they have a projection on both sides of the support body relative to its surface. Particularly preferably, the projection on the side of the support body facing towards the propellant charge is much less than on the side opposite this side, which preferably represents the side of the connection contact on a plug connection.

The metal rods may be coated with gold at least in subregions along their axis. Gold coating gives long-term resistance against corrosion. The metal rods are particularly preferably coated with gold on their end regions. In this way, the region of the metal rod which lies inside the plug connection when assembled for use of the ignition device is preferably gilded. In this way, the junction resistances in the plug contact can be reduced. Furthermore, the region which is connected to the ignition bridge is preferably also gilded.

In a preferred embodiment, at least two metal rods are electrically conductively connected to one another by an ignition bridge on the side of the support body facing towards the propellant. The ignition bridge may be formed by the ignition wire mentioned above, in which case on this side the metal rods preferably do not have a projection beyond the surface of the support body lying on this side, but also preferably by a carrier element which is connected to the metal rods, in which case the projection of the metal rods preferably exists. The support element may for example be an electrically conductively coated ceramic platelet and/or a special microchip.

In order to produce an ignition device, the feed-through element is conventionally welded with a cap. During welding, the support body is conventionally also heated, which puts at risk the glass material of the first access opening and/or the metallic solder of the second access opening, but also the propellant charge enclosed in the cavity formed by the cap and the feed-through element. In order to dissipate the heat, according to a preferred embodiment the support body comprises a welding edge. This preferably extends beyond the contour of the support body and preferably has a similar thickness to the material of the cap to be welded. The welded connection is then made between the welding edge and the cap. By radiating heat energy into the surrounding medium, the described welding edge is capable of protecting the access openings and/or the material contained in them and/or the propellant charge from excessive heating.

A method according to the present disclosure for producing a feed-through element of an ignition device for igniters of airbags or seatbelt tighteners comprises the method steps of producing a metal support body from a starting material by shaping, the outer contour of the support body being formed by the shaping method, forming at least one first access opening by shaping, the profile of the first access opening and the geometry of its diameter being formed by the shaping method used, fixing a first metal rod inside the first access opening by means of an electrically insulating fixing material, fixing a second metal rod inside a second access opening by means of a soldering process, in which the solder gap between the metal rod and the inner wall of the access opening is electrically conductively filled by means of a solder material in a solder region and the metal rod is thus electrically conductively connected to the support body, the at least one second access opening in which the metal rod is fixed by the soldered connection likewise being formed by shaping and a profile being created which comprises at least one predominantly cylindrical subregion, the diameter of which is at most 0.30 mm more than the diameter of a second metal rod which is fixed in this access opening.

Preferred shaping methods, which determine the outer contour of the support body, are cold forming and/or stamping. Cold forming has the main advantage over stamping that the components thereby formed are even more economical to produce than stamped parts. Depending on the material used, however, it may be more difficult and more cost-intensive to introduce the access openings into a cold-formed support body. For many materials, it may therefore be preferable to produce the support body by stamping from a part with a defined thickness.

Particularly preferably, the first and second access openings are stamped from the support body. The profiles of the access openings are then advantageously formed by the corresponding configuration of the stamping tool.

The metal rod is preferably fixed inside the second access opening so that the solder gap inside the solder region with the predominantly cylindrical profile has a maximum width of 0.23 mm, particularly preferably 0.20 mm.

During production of the second access opening, a profile with a predominantly cylindrical subregion is preferably formed which is followed by a region that is widened relative to the cylindrical subregion.

If the second access opening is produced by stamping, this is preferably done by a single stamping process in which the opening in the support body and its final profile are simultaneously formed in one working step.

The metal rod is preferably fixed essentially concentrically in the second access opening so that the solder gap inside the region with the predominantly cylindrical profile has a width of at most 0.18 mm.

The second access opening is preferably stamped with a diameter of 1.10±0.05 mm, measured in the predominantly cylindrical region, and the metal rod which is fixed in this access opening preferably has a diameter of 1.00±0.03 mm.

Stainless steel is preferably not used as the material for the support body. Instead, steels from the group (according to DIN EN 10 027-2) 1.01xx to 1.07xx are preferably used. The second access opening is formed with a diameter of 1.10+2*D±0.05 mm, measured in the predominantly cylindrical region. It is preferably stamped from the support body.

The support body together with the access openings is preferably coated with nickel, D indicating the thickness of the nickel layer in millimeters ("mm"). It is preferably from 1 mm to 15 mm, particularly preferably from 4 mm to 10 mm.

If the support body is stamped from a part with a predefined thickness, this preferably defines the thickness of the support body. The metal support body is therefore preferably stamped from a part with a thickness of from 1.70 to 3.00 mm, particularly preferably from 1.80 to 2.50 mm.

Preferably, in order to fix the first metal rod in the first access opening, a glass material is used as an electrically insulating fixing material which is heated in order to produce the fixing. This working step for fixing this first metal rod is preferably carried out with the working step for fixing the second metal rod in the second access opening by means of the soldered connection. A maximal throughput through the production system, together with the lowest system costs and therefore production costs, can thereby be achieved.

Preferably, the at least two metal rods are fixed in the access opening so that they have a projection on both sides of the support body relative to its surface.

Preferably, the at least two metal rods are selectively coated with gold in subregions in a further working step. This may be done by electrolytic processes which are known to the person skilled in the art.

Particularly preferably, the at least two metal rods may be coated with gold in their end regions.

Preferably, the at least two metal rods are electrically conductively connected to an ignition bridge. As described, the ignition bridge comprises all possible configurations of ignition bridges.

Silver, copper, nickel and/or aluminium-based solders, which are also known by the term hard solders, are preferably used as solder materials. They preferably contain Cu, CuAg, CuNi and/or other metals, and are provided as multicomponent systems.

Particularly preferably, the shaping method for producing the support body is configured so that a welding edge is likewise created on it during production.

It is generally known to the person skilled in the art that a method step described herein may take place on different workstations in successive working steps, even though a shaping process and/or stamping process is referred to. For example, the support body may be stamped out in stages, obtaining the final contour by moving the workpiece to different workstations which make a partial contribution to forming the final contour.

According to the present disclosure, the feed-through devices according to the present disclosure are preferably used in pyrotechnic ignition devices, particularly in airbag igniters and/or seatbelt tensioners.

The present disclosure will be explained in more detail below with the aid of the figures. The drawings are not true to scale, and the embodiments represented are schematic.

DETAILED DESCRIPTION OF THE INVENTION

Figure 1:
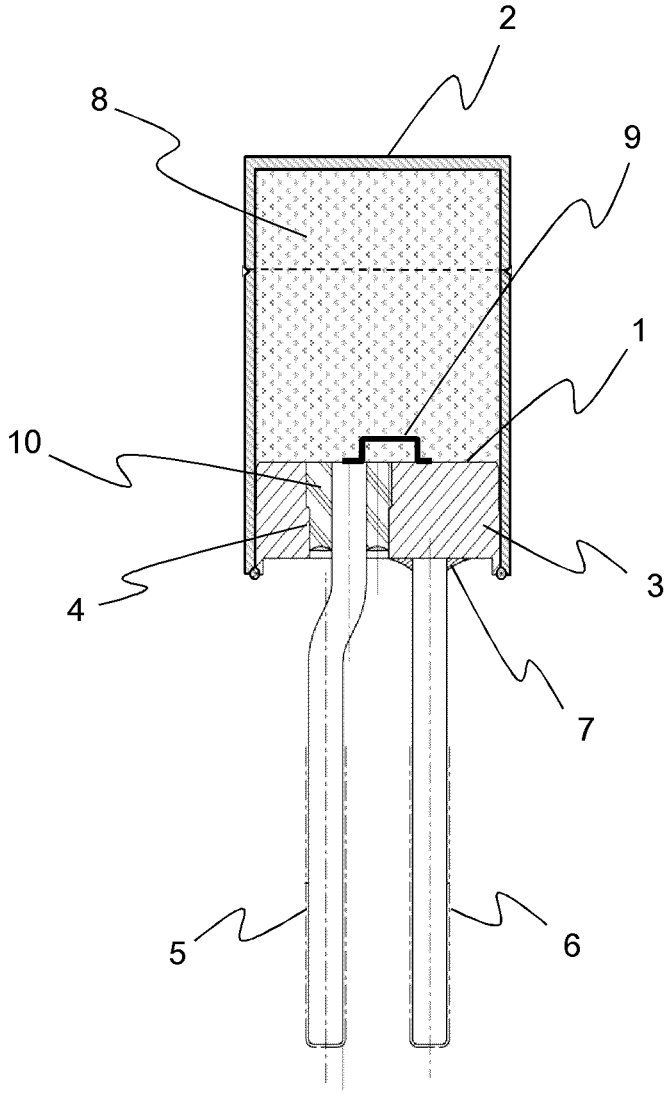
Fig. 1 (Prior Art)
FIG. 1 shows a known ignition device containing a feed-through element according to the prior art.

FIG. 1 represents a known ignition device for a pyrotechnic protection device according to the prior art. FIG. 1 shows in particular a sectional view of the feed-through element (1).

The feed-through element (1) comprises a shaped metal carrier part having a support body (3), which has a disc-shaped base shape. The feed-through element (1) is often also referred to as a base element or base for short. In order to avoid corrosion or reaction with the propellant charge, stainless steel is used as the material for the support body (3) in this ignition device, even though this material is more difficult to shape than many other metals.

In a first access opening (4) of the support body (3), a metal rod (5) is furthermore arranged as a pin. The access opening (4) has in this case been stamped from the support body (3). This likewise applies for the outer contour of the support body (3). In other embodiments, this access opening is drilled.

The metal rod (5) is used for contacting an ignition bridge (9) with electrical current, by means of which the propellant charge (8) enclosed in the finished igniter is ignited. The current feed-through in the access opening (4) is configured in particular as a glass-metal feed-through, glass being used as a fixing material (10) between the metal rod (5) and the wall of the access opening (4) in the metal support body (3). Such an electrical feed-through offers the particular advantage that it not only electrically insulates very well, but is also hermetically leaktight in relation to atmospheric constituents which can react with the propellant charge in the course of time or be mixed with it and degrade it. The use of such a current feed-through therefore allows reliable triggering of the igniter even after a long time.

In the example shown in FIG. 1, the access opening (4) is arranged off-centre with respect to the axial mid-axis of the support body (3). The effect achieved by this is that enough space is available for fastening the further metal rod (6) even when the support body (3) has a small radius. The further metal rod (6) is butt-soldered on the support body (3) by means of a soldered connection. The solders described are used as solder material (7). In order to make the ignition bridge (9) incandesce by means of a voltage pulse applied to the two metal rods (5, 6), in this embodiment it is accordingly also connected to the support body (3) or the cap (2), in addition to the metal rod (5). In order to improve the electrical contacting, conventional metal rods (5, 6) are used which have gilding at least in the connection region for a plug. This is represented in FIG. 1 by the dashed line in the end region of the metal rods (5, 6).

Figure 2:
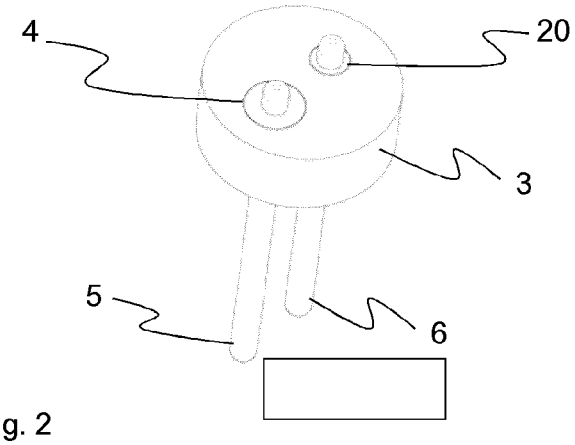
FIG. 2 shows a feed-through element according to the present disclosure in a perspective view.

FIG. 2 on the other hand shows the perspective view of a feed-through element (1) according to the present disclosure. The disc-shaped metal support body (3) in this embodiment comprises two stamped access openings (4) and (20), through which the metal rods (5) and (6) are fed as pins. The support body (3) together with its outer contour are produced by cold forming from a starting material, so that the entire support body (3) represents a shaped part. As an alternative, the support body (3) together with its outer contour may also be stamped from a part with a defined thickness. In the access opening (4), the metal rod (5) is fixed as a first pin while being electrically insulated from the support body (4) by means of a glass material (10). In the access opening (20), the second metal rod (6) is electrically conductively connected to the metal support body (3) by a soldered connection, and fixed in the access opening (20). The solders already described are used as the solder material. As may be seen, the diameter of the access opening (4), which contains the glass-metal feed-through, has a larger diameter than the access opening (20) in which the second metal rod (6) is soldered. In contrast to FIG. 1, the first metal rod (5) is not bent but straight. In the context of the present disclosure, both bent and straight metal rods are possible and covered by it.

Figure 3A:
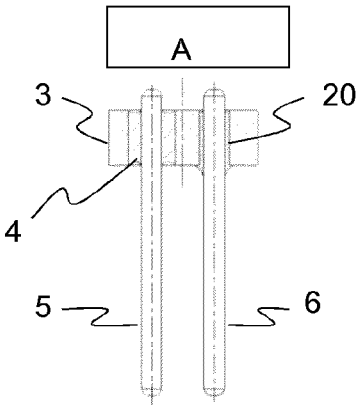
FIG. 3*a* shows a section through a feed-through element according to the present disclosure parallel to its axial mid-axis.

FIG. 3*a* represents the section of the feed-through element (1) according to the present disclosure parallel to its axial mid-axis (A) and through it. Here again, it can be seen that the glass-metal feed-through occupies a volume in the access opening (4) larger than the access opening (20) in which the metal rod (6) is soldered.

Figure 3B:
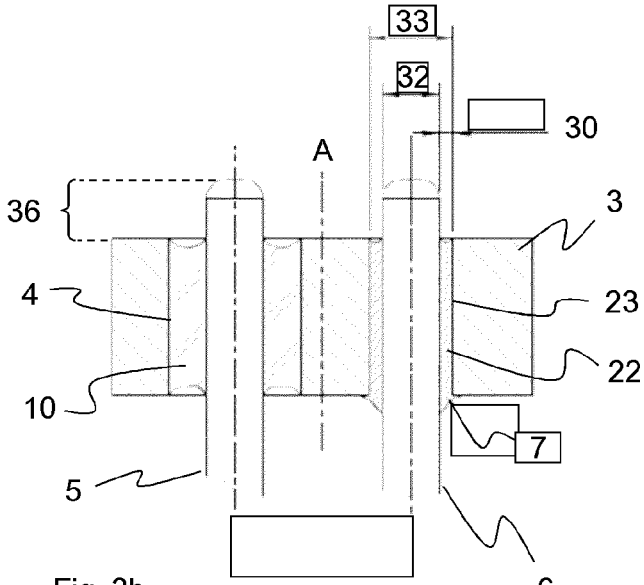
FIG. 3*b* shows an enlarged detail of FIG. 3*a*.

For illustration, FIG. 3*b* shows an enlargement of the view in FIG. 3*a*. The first metal rod (5) is placed hermetically sealed in the access opening (4). The glass material (10) of this glass-metal feed-through is entirely surrounded by the material of the support body (3), which represents the outer conductor. The glass material (10) preferably has a lower thermal expansion coefficient than the metal of the support body (3), so that when cooling after soldering the metal rod (5) into the glass material (10) the support body (3) so to speak shrinks onto it and therefore the glass-metal feed-through, and thus exerts a long-term mechanical pressure on it and the glass material (10). In this way, a particularly leaktight and mechanically stable connection is achieved between the metal rod (5), the glass material (10) and the support body (3). This arrangement is referred to as pressure vitrification, and is to be preferred for example for airbag igniters.

It can also be seen with the aid of the representation in FIG. 3*b* that the glass material (10) in the access opening (4) may be set back behind the end faces of the metal support body (3). This is achieved by the glass soldering process in the relatively large volume of the access opening and has the advantage that pressing of the glass, which makes the production process more expensive, is therefore unnecessary.

The second metal rod (6) is soldered in the second access opening (20). The solder material (7) electrically conductively fills the solder gap (30) in the solder region (22) between the metal rod (6) and the inner wall (23) of the access opening, and thereby fixes the metal rod (6) in the access opening (20). In the context of the present disclosure, the solder region (22) is that region which contains solder material (7) in the access opening (20). In FIG. 3*b*, it extends fully inside the access opening (20). At the lower end, the solder material (7) actually emerges from the access opening (20). At the upper end, it is set back slightly behind the surface of the support body (3). This form of soldered connection is often obtained by the adhesion forces of the molten solder on the inner wall (23) of the access opening (20) and the metal rod (6).

The access opening has a predominantly cylindrical profile in FIG. 3*b*, its diameter (33) having a predominantly round geometry. The metal rod (6) with the diameter (32) lies centrally in the access opening (20) in this figure, i.e. the metal rod (6) is arranged concentrically in the access opening (20). This means that the solder gap (30) has the same width (30) essentially everywhere in the access opening (20) shown in FIG. 3*b*. As can also be seen with the aid of FIGS. 3*a* and 3*b*, the metal rods (5) and (6) are fixed in the access openings (4, 20) with a projection (36) relative to the surface of the support body (3) which faces towards the propellant in the assembled ignition device. The presence of a projection (36) of the metal rods on this side of the support body (3) is particularly advantageous when the above-described ceramic platelets or special microchips are used as the ignition bridge (9).

Figure 4A:
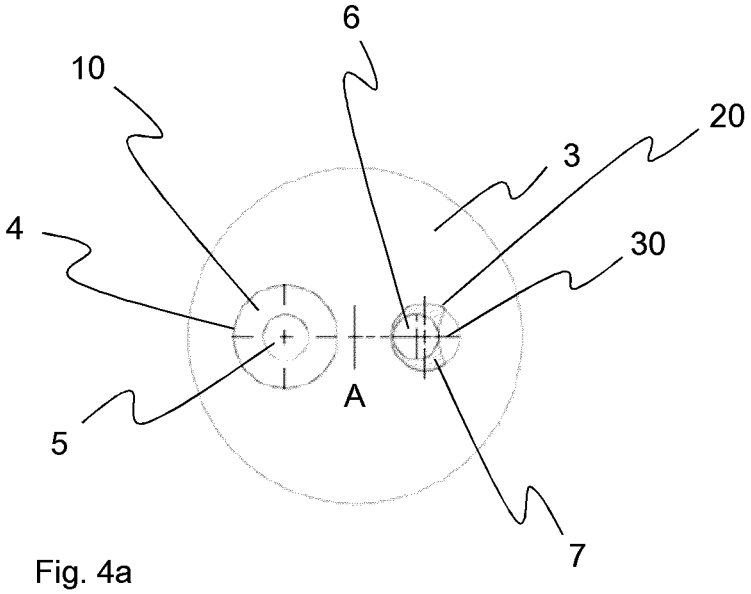
FIG. 4*a* shows the plan view of a feed-through element according to the present disclosure.

FIG. 4*a* schematically represents the plan view of a feed-through element according to the present disclosure, in which the second metal rod (6) is not arranged concentrically in the access opening (20) but touches an inner wall (23) of this access opening. The solder material (7) is present at least in subregions of the access opening (20). Amounts of solder material (7) are selected which are sufficient for thermal fixing of the metal rod (6). Optional additional sealing of the access opening (20) may be achieved by other means. However, it is preferable for the solder material (7) to close the solder gap (30) so that no other sealing is necessary. The dimensions of the solder gap (30) with non-concentric arrangements of the metal rod (6) in the access opening (20) are specified in the context of this description at the position where the solder gap (30) has its maximum width. Of course, with the non-concentric arrangement, arrangements are also possible in which there is a differently wide solder gap (30) on all sides of the metal rod (6).

Figure 4B:
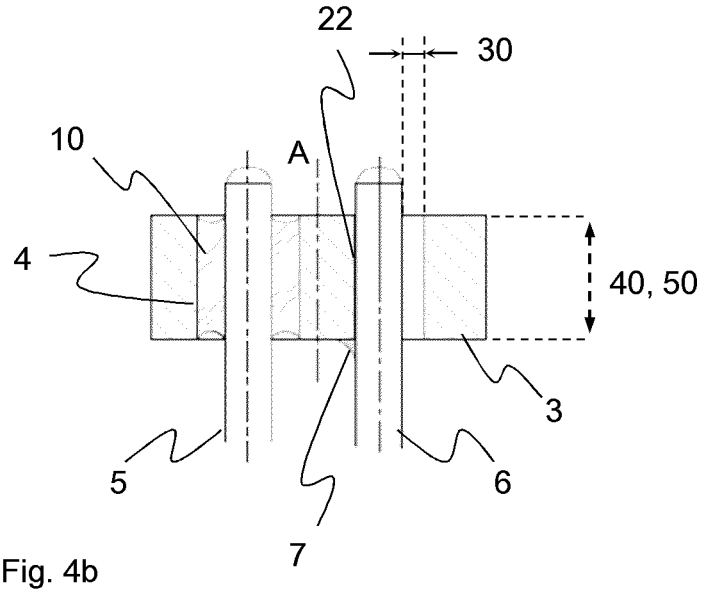
FIG. 4*b* shows a section through the feed-through element according to the present disclosure according to FIG. 4*a* parallel to its axial mid-axis.

FIG. 4*b* shows for illustration a section through the feed-through element according to FIG. 4*a* parallel to its axial mid-axis (A) and through it. The support body has a thickness (40), and the metal rod (6) is in direct contact with the inner wall (23) of the access opening (20). In this embodiment as well, the access opening (20) has a predominantly cylindrical profile over its entire length. The solder region (22) lies inside this profile at least in subsections, but as described need not necessarily be in contact with the entire inner wall (23) of the access opening (20). As can be seen with the aid of the FIG. 4*b*, the solder material (7) may in addition also lie outside the access opening (20). Such configurations may be obtained by wetting of the support body (3) and the metal rod (6) with liquid solder material (7). In the version according to FIG. 4*b*, it is naturally also possible for there to be a thin layer of solder material (7) between the metal rod (6) and the inner wall (23) of the access opening (20), although this is not represented in FIG. 4*b*.

Figure 5:
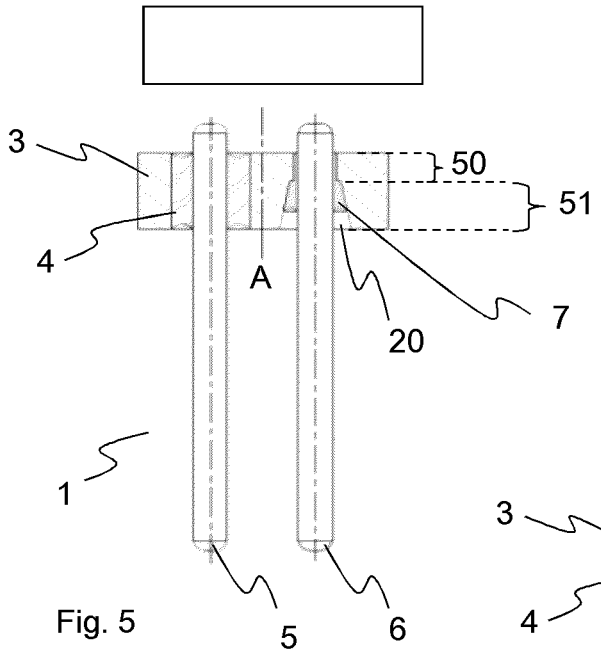
FIG. 5 shows the section through an embodiment of a feed-through element according to the present disclosure parallel to its axial mid-axis.
Figure 6:
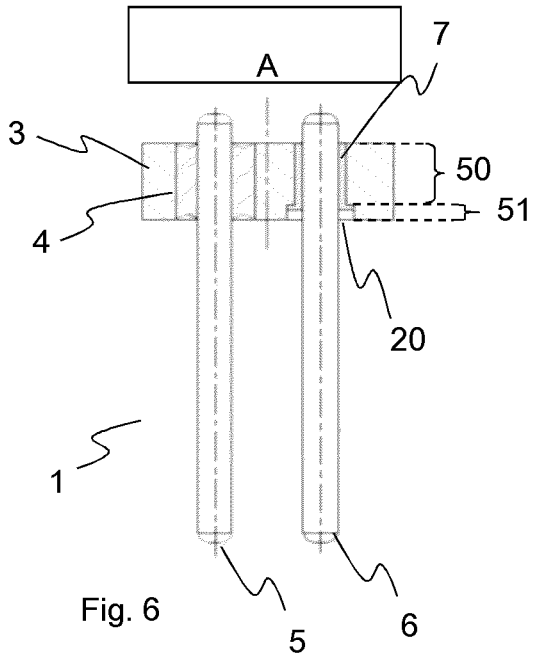
FIG. 6 shows the section through another embodiment of a feed-through element according to the present disclosure parallel to its axial mid-axis.
Figure 7:
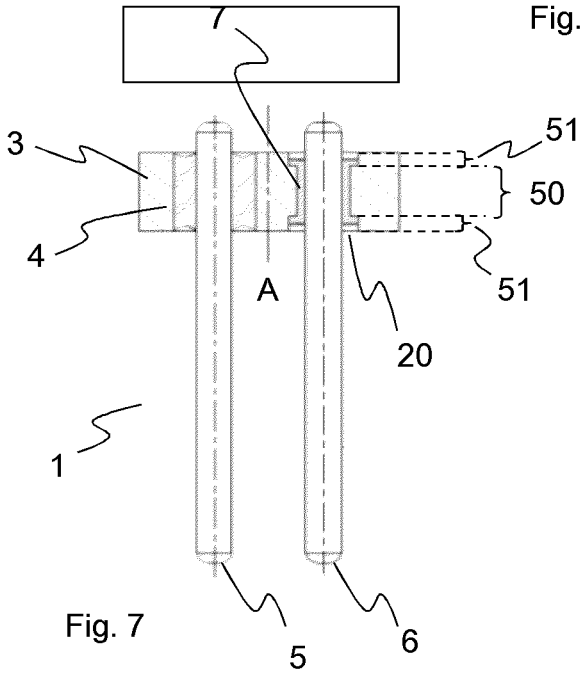
FIG. 7 shows the section through yet another embodiment of a feed-through element according to the present disclosure parallel to its axial mid-axis.

FIGS. 5 to 7 show other particular embodiments of feed-through elements (1) according to the present disclosure. FIG. 5 represents a feed-through element in which the access opening (20) has a region with a predominantly cylindrical profile (50), which is followed by a region with a profile (51) widened relative to it. This region (51) has a conical shape in FIG. 5. The solder material (7) preferably surrounds the metal rod (6) over its entire circumferential surface at least in subregions of its length lying in the access opening (20), so that the solder gap (30) is entirely filled with solder material (7) at least in subregions of the predominantly cylindrical profile (50) of the access opening (20). In this way, the access opening (20) can be hermetically sealed, the metal rod (6) being fixed with a high extraction force in this access opening (20).

In the embodiment according to FIG. 5, the solder region (22) extends entirely in the region with the predominantly cylindrical profile (50) and partially in the region with the widened profile (51). Embodiments may however also be envisaged in which the solder region lies only in subregions of the region (50) with the predominantly cylindrical profile, or ones in which the entire access opening (20) is filled with solder material (7) in the regions (50) and (51).

The access opening (20) shown in FIG. 5 can be formed most simply by a single stamping process which is carried out from the upper side of the support body (3), i.e. the side facing away from the region with the conical profile (51). The conical profile (51) is then conventionally created by splitting the material of the support body (3). In a two-part stamping process, however, it is also possible to introduce the region with the conical profile (51) into the support body (3) from the lower side in a second stamping process, after stamping the region with the predominantly cylindrical profile (50), in which case the region with the conical profile (51) is then so to speak imposed on the access opening (20).

FIG. 6 shows another embodiment, in which the region with the widened profile (51) is again substantially cylindrical. Here as well, this region (51) may again be filled at least partially with solder material (7). Such embodiments may preferably be produced by a two-stage stamping process, in which the widened cylindrical profile (51) is again stamped in the support body (3) from the lower side of the access opening (20), as described above. With two-stage stamping processes, it is of course also possible for other shapes, in particular its outer contour, to be imposed on the support body (3) and/or stamped from it in the second stamping process.

According to FIG. 7, the regions (51) which are widened in comparison with the predominantly cylindrical profile (50) may also lie at both ends of the access opening (20). Although regions (51) again with cylindrical profiles are shown in FIG. 7, it is likewise possible for one or both widened regions (51) to have cylindrical profiles. The configuration according to FIG. 7 is again most simply formed by a two-stage stamping process, in which the widened profile (51) is made on the above-defined upper side of the support body (3) simultaneously with the stamping of the access opening (20). It is, however, also possible to use a stamping process which contains more than two process steps. In general, however, the production costs also increase with the number of process steps.

Particularly when the support body (3) has a larger thicknesses (40), different process management for using a multi-stage stamping process is advantageous, in which the widened regions (51) are first stamped into the support body (3)

with a stamping tool of larger diameter. In at least one subsequent stamping process, the access openings (20) are then formed with a stamping tool of smaller diameter, the region with the predominantly cylindrical profile (50) preferably being formed. This increases the lifetime of the stamping tool and, in particular when the support body (3) has larger thicknesses (40), makes it possible to form a subregion having a predominantly cylindrical profile (50) with sufficient accuracy, which is required for successful soldering of the metal rod (6) in the access opening (20).

Figure 8:
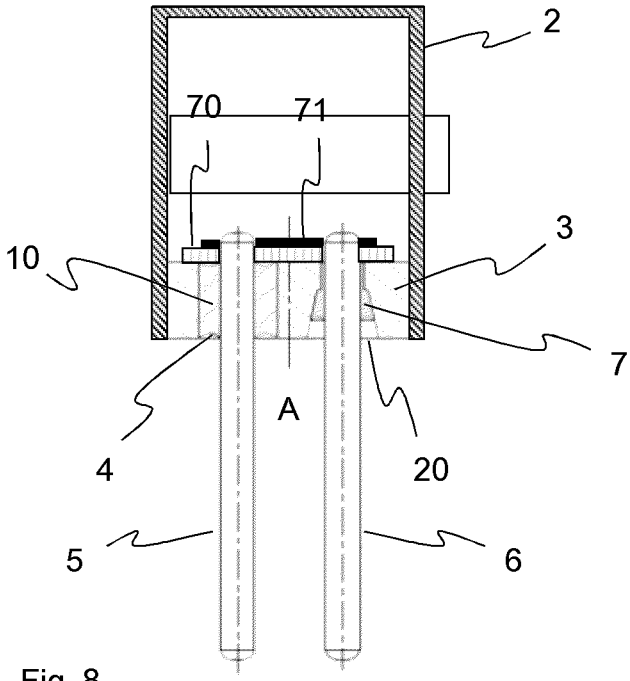
FIG. 8 shows the section through a pyrotechnic ignition device having a feed-through element according to the present disclosure, parallel to its axial mid-axis.

FIG. 8 schematically shows the section through a possible pyrotechnic ignition device having a feed-through element (1) according to the present disclosure, parallel to its axial mid-axis (A). It comprises the base according to FIG. 5 described above, which in the known way and as represented in FIG. 1 is closed by a cap (2). The closure is conventionally achieved by laser-welding the cap (2) to the outer edge of the support body (3). Other methods, such as friction welding or pressing, are likewise possible. The cavity formed by the cap (2) and the support body (3) is conventionally filled with a propellant (8), which is not represented in FIG. 8.

The two metal rods (5) and (6) have a projection relative to the surface of the support body (3) facing towards the cavity. On this surface, according to FIG. 8, an electrically insulating carrier platelet (70) is applied which in the embodiment represented comprises recesses for the metal rods (5) and (6). Ceramic is preferably used as the material for the support platelet, although sintered glass or suitable plastics may likewise be used as the material. On the carrier platelet (70), there is a conductor (71) which in this example is configured as a thick-film conductor. Instead of a thick-film conductor or in addition, it is likewise possible to arrange a microchip on the carrier platelet (70) in order to trigger the ignition or provide the ignition device with further functions.

According to this embodiment, the conductor (71) is conductively connected to the metal rods (5, 6) and is used as an ignition bridge, which ignites the propellant charge and can thus trigger the ignition device. The connection between the metal rods (5, 6) and the conductor (71) can be produced in a particularly simple way by conventional soft solder. In this embodiment, this solder has no tasks other than establishing a conductive connection, because the first access opening (4) has already been hermetically closed by the glass material (10) and the second access opening (20) already by the solder material (7). This embodiment has the advantage that the feed-through element (1) according to the present disclosure does not require any reprocessing of the surface of the support body (3) facing the cavity and of the access openings (4, 20) when using the carrier platelet (70) and the conductor (71) applied on it. The ignition device according to FIG. 8 is therefore particularly economical to produce.

All the embodiments with the widened regions (51), as shown in FIGS. 5 to 8, have the advantage that owing to the widened regions (51) it is possible for excess solder material (7) to be collected in these regions so that projection of the solder material (7) beyond the surface of the support body (3), as shown in FIGS. 3*b* and 4*b*, can be prevented.

Figure 9:
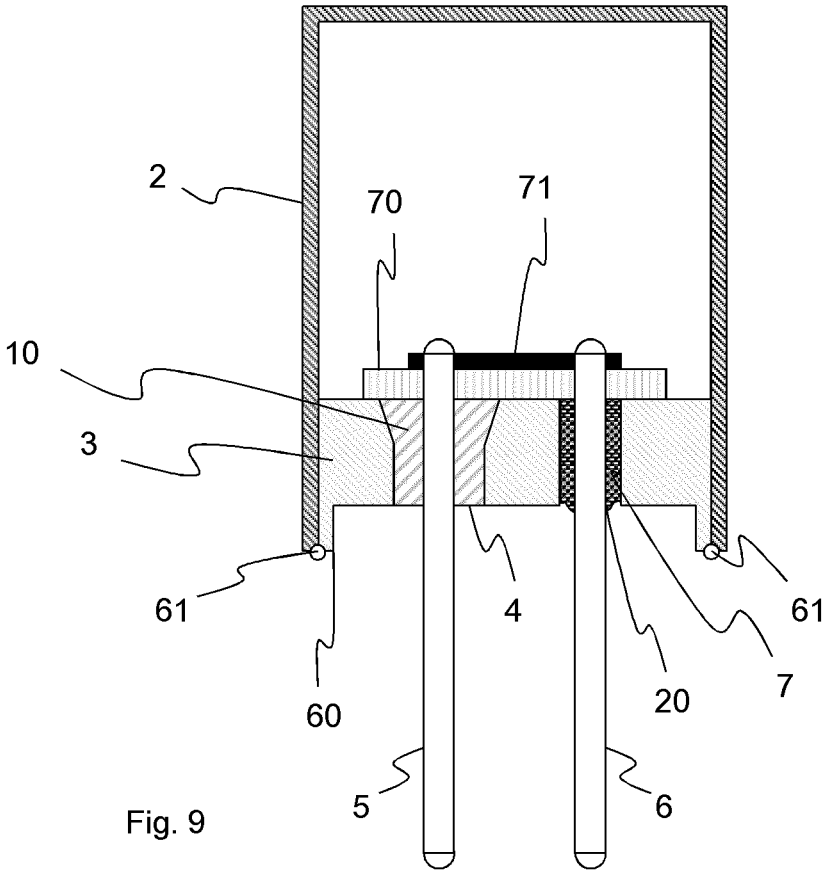
FIG. 9 shows the section parallel to the axial mid-axis of a pyrotechnic ignition device having another embodiment of a feed-through element according to the present disclosure with a welding edge.

FIG. 9 schematically represents the section parallel to the axial mid-axis through a pyrotechnic ignition device having another embodiment of a feed-through element (1) according to the present disclosure. As in FIG. 8, the cap (2) closes the ignition device and thus forms a cavity with the support body (3), which is filled as in FIG. 1 with the propellant (8) (not shown). The access opening (4) closed by the glass material (10) has a contour tapering towards the lower side, i.e. the surface of the support body (3) facing away from the cavity. This contour can be used to avoid relative movements of the glass material (10) in relation to the support body (3), which may occur in the event of high explosive pressures when igniting the propellant (8). If such relative movements occur, this may entail reduced function of the ignition device. Relative movements of the glass material (10) in relation to the support body (3) are therefore undesirable.

As in FIG. 8, the ignition bridge of the ignition device represented in FIG. 9 is formed by a conductor (71) arranged on a carrier platelet (70). The cap is conventionally welded to the support body as already described with reference to FIG. 8. During welding, however, the support body (3) is likewise heated. In the event of excessive heating, this can cause damage to the closure of the access openings (4, 20), in particular by damaging the glass material (10) and/or the solder material (7) or its bond with the support body (3). Likewise, it is absolutely necessary to protect the propellant (8) from excessive heating. According to the embodiment represented, the feed-through element (1) according to the present disclosure is therefore provided with a welding edge (60) which protrudes in line with the side surface of the support body (3) beyond the lower side of the support body (3). It is naturally also possible for the welding edge (60) to protrude in line with the lower side of the support body (3) beyond its side surface. The welded connection is preferably, and as represented in FIG. 9, made on the outer edge of the cap (2) and the welding edge (60) in the welding region (61). The protruding welding edge (60) is capable of radiating the heat energy, introduced by the welding, into the medium surrounding the support body (3) so as to reduce the heating of the access openings (4, 20) and the propellant (8) in comparison with embodiments without a welding edge (60). During production of the support body (3), the welding edge is preferably formed by shaping with and/or on it.

As described, the metal rods (5) and (6) are preferably coated with gold in their end regions. This is not represented in FIGS. 2 to 9, but is likewise covered by the present disclosure. It is also possible to combine all shown or possible geometries of the access openings (4) filled by glass material (10) in a feed-through element (3) according to the present disclosure with all shown or possible geometries of the access openings (20) filled with solder material (7). All feed-through elements (3) according to the present disclosure may likewise comprise a welding edge (60).

FIGS. 2 to 9 also show embodiments in which the axes of the metal rods (5) and (6) and/or the mid-points of the access openings (4) and (20) lie at the same distance from the axial mid-axis (A). In the context of the present disclosure, however, it is also possible for the mid-points of the access openings (4) and (20) to be arranged not at the same distance from the axis (A), as shown in FIG. 1. Correspondingly, straight and/or bent metal rods (5) and (6) may also be used in the context of the present disclosure.

Particularly preferably, the support body (3) is formed in a predefined way by stamping from a part. This is conventionally done in a stamping process, but on different workstations by means of different working steps. This creates a support body (3) with the desired thickness (40) and the desired contour. Particularly preferably, the access openings (4, 20) are thereupon stamped out from the support body (3) in one or more working steps, the profile of the access openings (4, 20) being formed.

Also particularly preferably, the support body (3) is produced by cold forming. In this case, a piece of a wire of the material of the support body (3) is cut off, the product of length and diameter of which corresponds essentially to the product of the diameter and thickness (40) of the support body. The cut wire portioned is thereupon cold-formed in one or more working steps, particularly preferably pressed into a mould, so that the support body (3) with the desired structure and thickness (40) is obtained. The access openings (4, 20) are particularly preferably stamped from this support body in one or more working steps as described above. Because the cut wire piece may be compressed during shaping, it is possible for the support body obtained to be so hard that a softening anneal of the support body (3) has to be carried out before stamping out the access openings (4, 20).

Shaping methods, in particular cold forming and stamping, are particularly economical methods compared with material-removal production methods, for example turning on a lathe and drilling. The feed-through element (1) according to the present disclosure, and the method for its production, therefore allow a more economical version of an ignition device than those known from the prior art. Despite the highly rational production possibilities, they fulfil the high safety standards which are demanded of those ignition devices in particular for person protection devices. The feed-through element (1) according to the present disclosure is mechanically more stable than the known feed-through elements with the pressed glass base, but have their advantages in relation to the choice of materials and possible configurations of the ignition bridges (9). By soldering the second metal rod (6) in the predominantly cylindrical region (50) of the access opening, it is possible for the metal rod (6) to withstand extraction forces of more than 350 N, in particular more than 380 N. The extraction force is likewise a measure of the pressure-proofness of the access opening (20) when igniting the propellant (8). The highest possible extraction forces are desired. The values achieved ensure use of the feed-through elements (1) according to the present disclosure in all ignition devices for person protection apparatus, in particular airbag igniters and/or seatbelt tensioners.

What is claimed is:

1. A feed-through element of a pyrotechnic ignition device, the feed-through element comprising:

a metal support body;

a first access opening, in which a first cylindrical metal rod is arranged in an electrically insulating fixing material;

a second access opening, in which a cylindrical second metal rod is hermetically fixed by a soldered connection in a solder region without the second metal rod contacting the electrically insulating fixing material, the soldered connection comprising solder material electrically conductively filling a solder gap between the second metal rod and an inner wall of the second access opening; and a shaped outer contour of the metal support body, the first access opening, and the second access opening, wherein the second access opening comprises a first region having a cylindrical profile at the solder region, the first region having a diameter that differs from a diameter of the second metal rod by at most 0.30 millimeters.

2. The feed-through element according to claim 1, wherein the metal support body is a stamped part and/or a cold-formed part from which the first and second access openings have been stamped out.

3. The feed-through element according to claim 1, wherein the second access opening further comprises a second region having a widened profile relative to the cylindrical profile of the first region.

4. The feed-through element according to claim 1, wherein the solder gap inside the solder region with the cylindrical profile has a maximum width of 0.23 millimeters.

5. The feed-through element according to claim 1, wherein the solder gap inside the solder region with the cylindrical profile has a maximum width of 0.20 millimeters.

6. The feed-through element according to claim 1, wherein the second metal rod is fixed essentially concentrically in the second access opening and wherein the solder gap inside the solder region with the cylindrical profile has a width of at most 0.18 millimeters.

7. The feed-through element according to claim 1, wherein the diameter of the second access opening is 1.10±0.07 millimeters.

8. The feed-through element according to claim 1, wherein the diameter of the second metal rod is 1.00±0.05 millimeters.

9. The feed-through element according to claim 1, wherein the solder region lies entirely inside the first region with the cylindrical profile of the second access opening.

10. The feed-through element according to claim 1, wherein the metal support body is not made from stainless steel.

11. The feed-through element according to claim 1, wherein the metal support body is made from a steel from the group according to DIN EN 10 027-2 of 1.01xx to 1.07xx.

12. The feed-through element according to claim 11, wherein the metal support body is coated with nickel.

13. The feed-through element according to claim 1, wherein the metal support body has a thickness of from 1.70 to 3.00 millimeters.

14. The feed-through element according to claim 1, wherein the first and second metal rods have a projection on both sides of the metal support body.

15. The feed-through element according to claim 1, wherein the feed pyrotechnic ignition device comprises an airbag igniter or a seatbelt tensioner.

16. The feed-through element according to claim 1, wherein the first access opening has a first diameter and the second access opening has a second diameter, and wherein the first diameter is greater than the second diameter.

17. A method for producing a feed-through element of an ignition device for igniters of airbags or seatbelt tighteners, comprising the steps of:

producing a metal support body by shaping an outer contour;

forming a first access opening by shaping a first profile and a first diameter of the first access opening;

fixing a cylindrical first metal rod inside the first access opening by an electrically insulating fixing material;

forming a second access opening by shaping a second profile and a second diameter of the second access opening, the second profile comprising a predominantly cylindrical subregion; and hermetically fixing a cylindrical metal rod inside the a second access opening by an electrically conductive solder material so that the second metal rod is electrically conductively connected to the metal support body without contacting the electrically insulating fixing material, wherein the second diameter is at most 0.30 millimeters more than a diameter of the second metal rod to define a solder gap between the second metal rod and an inner wall of the second access opening.

18. The method according to claim 17, wherein the step of producing the metal support body comprises cold forming the metal support body from a part of defined thickness.

19. The method according to claim 17, wherein the step of producing the metal support body comprises stamping the metal support body from a part of defined thickness.

20. The method according to claim 17, wherein the steps of forming the first access opening and forming the second access opening comprise stamping the first and second access openings from the metal support body.

21. The method according to claim 17, wherein the step of fixing the second metal rod inside the second access opening comprises fixing the second metal rod so that the solder gap has a maximum width of 0.23 millimeters.

22. The method according to claim 17, wherein the step of forming the second access opening further comprises forming a subregion that is widened relative to the predominantly cylindrical subregion.

23. The method according to claim 17, wherein the second diameter of the second access opening is 1.10±0.05 millimeters, measured in the predominantly cylindrical region, and the diameter of the second metal rod is 1.00±0.03 millimeters.

24. The method according to claim 17, wherein the metal support body has a thickness of from 1.70 to 3.00 millimeters after shaping.

25. The method according to claim 17, wherein the step of fixing the first metal rod in the first access opening comprises heating a glass material to fix the first metal rod in the first access opening.

26. The method according to claim 17, wherein the steps of fixing the first and second metal rods in the first and second access openings, respectively, comprise fixing so that a projection of the first and second metal rods is on both sides of the metal support body.

27. The method according to claim 17, wherein the first access opening has a first diameter and the second access opening has a second diameter, and wherein the first diameter is greater than the second diameter.

28. A method for producing a feed-through element of an ignition device for igniters of airbags or seatbelt tighteners, comprising the steps of:

producing a metal support body by shaping an outer contour;

forming a first access opening by shaping a first profile and a first diameter of the a first access opening;

fixing a cylindrical first metal rod inside the first access opening by an electrically insulating fixing material;

forming a second access opening by shaping a second profile and a second diameter of the second access opening, the second profile comprising a predominantly cylindrical subregion;

fixing a cylindrical second metal rod inside the second access opening by an electrically conductive solder material so that the second metal rod is electrically conductively connected to the metal support body, wherein the second diameter is at most 0.30 millimeters more than a diameter of the second metal rod to define a solder gap between the second metal rod and an inner wall of the second access opening, wherein the step of producing the metal support body comprises selecting a material other than stainless steel and coating the metal support body with a nickel layer after the steps of forming the first and second access openings.

29. The method according to claim 28, wherein the second diameter of the second access opening is 1.10+2*D±0.05 millimeters, where D indicates a thickness of the nickel layer in millimeters.

30. A method for producing a feed-through element of an ignition device for igniters of airbags or seatbelt tighteners, comprising the steps of:

producing a metal support body by shaping an outer contour;

forming a first access opening by shaping a first profile and a first diameter of the first access opening;

fixing a cylindrical first metal rod inside the first access opening by an electrically insulating fixing material;

forming a second access opening by shaping a second profile and a second diameter of the second access opening, the second profile comprising a predominantly cylindrical subregion; and hermetically fixing a cylindrical second metal rod inside the second access opening by an electrically conductive solder material so that the second metal rod is electrically conductively connected to the metal support body, wherein the step of fixing the first metal rod in the first access opening is simultaneous to the step of fixing the second metal rod in the second access opening.

31. A feed-through element of a pyrotechnic ignition device, the feed-through element comprising:

a metal support body having a first access opening and a second access opening;

a cylindrical first metal rod hermetically held in the first access opening by an electrically insulating fixing material; and a cylindrical second metal rod electrically conductively and hermetically fixed to the metal support body by a soldered connection in a solder region, the soldered connection comprising solder material electrically conductively filling a solder gap between the second metal rod and an inner wall of the second access opening, wherein the electrically insulating fixing material does not contact the second metal rod.

* * * * *